United States Patent [19]

Fuhrmeister

[11] Patent Number: 4,615,475

[45] Date of Patent: Oct. 7, 1986

[54] FEEDERS FOR HEADED FASTENERS

[75] Inventor: Ralph Fuhrmeister, Coopers Plains, Australia

[73] Assignee: Neitek Pty. Ltd., Coopers Plains, Australia

[21] Appl. No.: 698,179

[22] PCT Filed: May 24, 1984

[86] PCT No.: PCT/AU84/00093

§ 371 Date: Jan. 25, 1985

§ 102(e) Date: Jan. 25, 1985

[87] PCT Pub. No.: WO84/04710

PCT Pub. Date: Dec. 6, 1984

[30] Foreign Application Priority Data

May 27, 1983 [AU] Australia ..... PF9567
Dec. 16, 1983 [AU] Australia ..... PG2864

[51] Int. Cl.[4] ..... B25C 5/02; B23P 19/00
[52] U.S. Cl. ..... 227/136; 227/51
[58] Field of Search ..... 227/51, 136, 52, 60, 227/61, 62; 29/798

[56] References Cited

U.S. PATENT DOCUMENTS

| | | | |
|---|---|---|---|
| 2,680,246 | 6/1954 | Rambo | 227/136 |
| 2,923,937 | 2/1960 | Laucher | 227/136 X |
| 3,698,599 | 10/1972 | Fernstrom | 221/25 |
| 3,826,419 | 7/1974 | Maestri | 227/136 |
| 4,014,488 | 3/1977 | Potucek et al. | 227/136 X |
| 4,410,103 | 10/1983 | Fuhrmeister | 221/25 |

FOREIGN PATENT DOCUMENTS

| | | |
|---|---|---|
| 57419/69 | 1/1971 | Australia . |
| 488189 | 11/1977 | Australia . |
| 17381/76 | 3/1978 | Australia . |
| 28869/77 | 3/1979 | Australia . |
| 504196 | 10/1979 | Australia . |
| 68118/81 | 9/1981 | Australia . |
| 1923712 | 11/1970 | Fed. Rep. of Germany . |
| 1234978 | 5/1960 | France . |
| 1531728 | 7/1968 | France . |
| 470239 | 5/1969 | Switzerland . |
| 1163790 | 9/1969 | United Kingdom . |
| 1333834 | 10/1973 | United Kingdom . |

*Primary Examiner*—Paul A. Bell
*Attorney, Agent, or Firm*—Schwartz, Jeffery, Schwaab, Mack, Blumenthal & Evans

[57] ABSTRACT

A feeder for headed fasteners, such as rivets (43), driven at equal intervals through a tape (44), is applicable to a riveting machine (10) and includes a plunger (25) advanced and retracted through a guide bush (29) and with a punch (37) at its leading end. When the plunger (25) advances the punch (37) is driven through a delivery passage in the guide bush head (39). A guide tube (45) leads the tape (44) to bring fasteners (43) in sequence into the rivet delivery passage (52). An actuator (56), oscillatable in the guide bush (39), is moved to retracted position by the advancing plunger (25), and is automatically returned to advanced position when the plunger (25) retracts. Fastener engaging means (64) on the actuator (56) act, with each retraction and advance of the actuator (56), to engage a fastener (43) and move it towards the delivery passage from which the leading fastener (43) is driven by the advancing punch (37) which, penetrating the tape (44) holds the tape (44) against movement while the actuator (56) is moved to its retracted position.

11 Claims, 8 Drawing Figures

FEEDERS FOR HEADED FASTENERS

BACKGROUND OF THE INVENTION (1) Field of the Invention

This invention relates to improvements in feeders for headed fasteners such as rivets, and to riveting machines incorporating such feeders.

(2) Brief Description of the Prior Art

Our Australian Pat. Nos. 488189 and 504196 (and corresponding British Pat. Nos. 1,502,475 and 1,538,027 respectively) disclose methods of and apparatus for riveting where the rivets punch their own holes through the work pieces to be joined.

U.S. Pat. No. 4,410,103 a method and apparatus for sequentially feeding rivets to such riveting machines from a tape charged with rivets according to the method and apparatus disclosed in U.S. Pat. No. 4,404,742.

These riveting machines and feeders for directing rivets to them have been found to be efficient and generally satisfactory in use, but they are fairly bulky and expensive to manufacture and install.

SUMMARY OF THE PRESENT INVENTION

The present invention has been devised with the general object of providing a feeder for rivets or other headed fasteners which is particularly simple, economical and compact, which is applicable to a readily portable riveting machine, and which is very convenient to use and efficient and positive in action.

With the foregoing and other objects in view, the invention resides broadly in a feeder for sequentially feeding, from a flexible carrier tape, headed fasteners driven therethrough in equally spaced intervals, including:

- a guide bush,
- a delivery passage through the guide bush,
- a guide passage in the guide bush for guiding the fasteners in sequence to the delivery passage,
- a plunger mounted for advance into and retraction from the delivery passage,
- a punch at the leading end of the plunger,
- means for advancing the plunger to drive the punch through the tape, expelling a fastener therefrom into the delivery passage,
- means for retracting the plunger to withdraw the puch from the carrier tape,
- an actuator oscillatably mounted in the guide bush for movement by the advancing plunger from an advanced position to a retracted position,
- actuator return means for removing the actuator from its retracted position to its advanced position upon the retraction of the plunger, and
- fastener engaging means on the actuator adapted, with successive oscillations of the actuator, to engage the advance sequentially towards the discharge passage, the fasteners of the carrier tape.

The invention further resides in a rivet setting machine incorporating the feeder set out above.

DETAILED DESCRIPTION OF THE PREFERRED EMBODIMENTS

Figure 1:
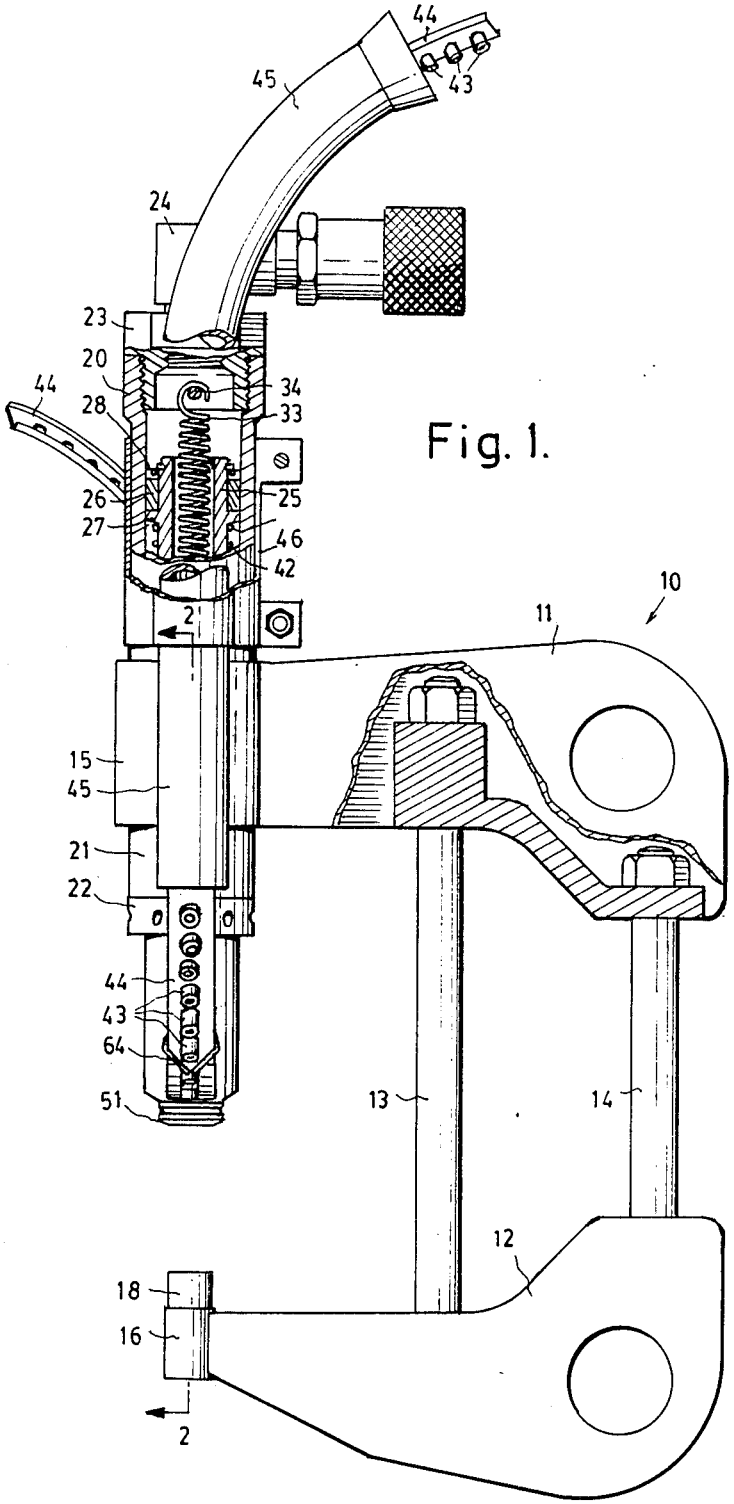
FIG. 1 is a partly broken-away side elevational view of a rivet setter incorporating a rivet feeder according to the invention.

The rivet setter includes a C-frame 10 having upper and lower jaws 11 and 12 rigidly interconnected by a tension post 13 and a compression post 14, both of which are interchangeable with others of different lengths for adjustment of the frame to suit different requirements. The upper jaw 11 is provided with a cylindrical clamp collar 15, the lower jaw with a coaxial cylindrical holder 16 for a rivet upsetting die 18, which is secured by a screw 19 and interchangeable with others of different axial length.

A hydraulic cylinder 20 is secured in axially adjustable manner in the clamp collar 15, being formed with a circumferential shoulder to bear on the top of the clamp collar, a spacer collar 21 then being fitted on the hydraulic cylinder from below and secured by a lock nut 22 screwed onto the bottom part of the cylinder. By fitting the spacer collar above, instead of below, the clamp collar, or by using shorter spacer collars above and below the clamp collar, the hydraulic cylinder may be adjusted axially.

The top of the hydraulic cylinder is closed by a plug 23, an elbow 24 having one arm engaged in a threaded axial hole through the plug having its other arm connected to a hydraulic pressure line (not shown) from any suitable preferably portable source (not shown) of hydraulic fluid under pressure.

A hollow plunger 25 is coaxially slidable in the cylinder 20, a bush 26 slidable in the cylinder being secured about its upper part, between a circumferential shoulder 27 about the plunger and an annular seal 28. The lower part of the plunger 25 is slidable in a guide bush 29 which itself is slidable in the cylinder 20, the slidable movement of the plunger relative to the guide bush being restricted by a key 30 screwed into the plunger and engaging in a longitudinal slot 31 in the guide bush 29.

The slidable extension of the plunger 25 in the cylinder 20 is limited by a stop ring 32 seated in an annular groove in the wall of the cylinder and against which the shoulder 27 of the plunger is brought if the normal stroke of the plunger should be accidentally exceeded.

Figure 2:
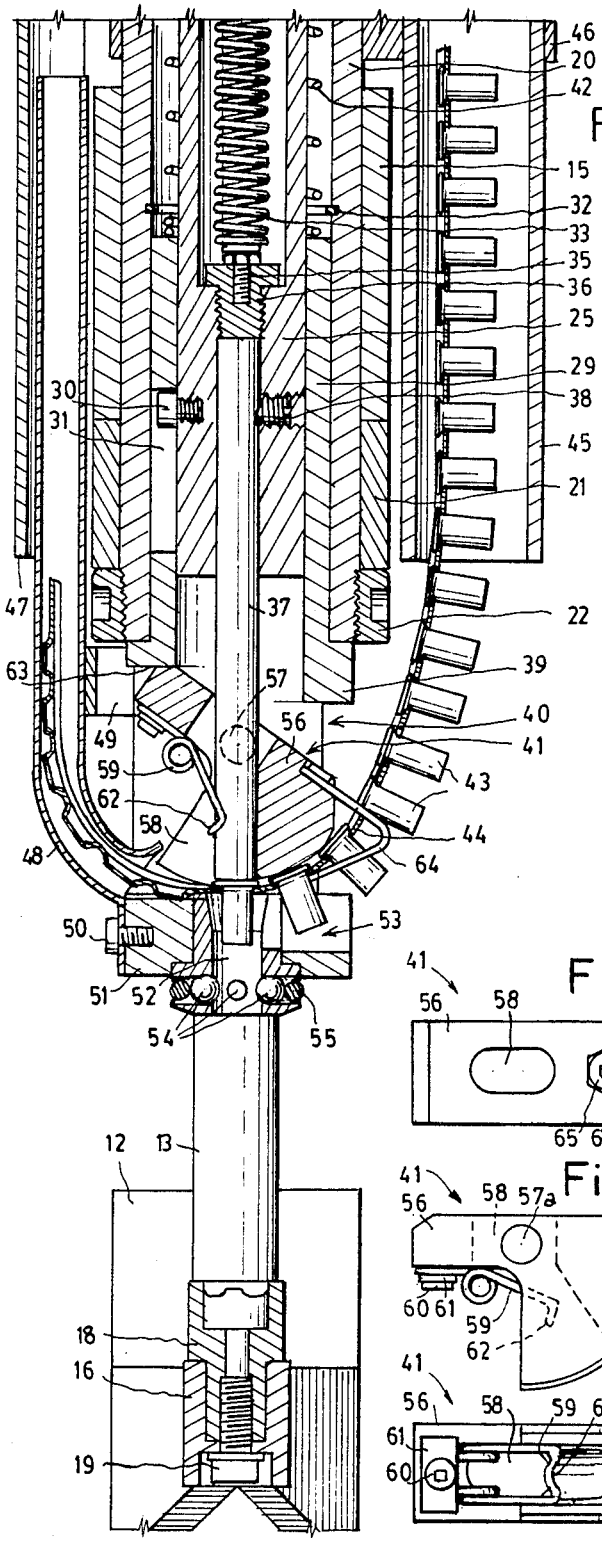
FIG. 2 is a sectional view, to larger scale, along side 2—2 in FIG. 1, showing the device prior to ejection and setting of a rivet.
Figure 4:
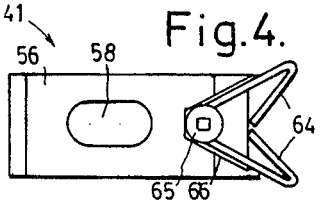
FIG. 4 is a plan view of the actuator of the device shown in FIGS. 1, 2 and 3.
Figure 5:
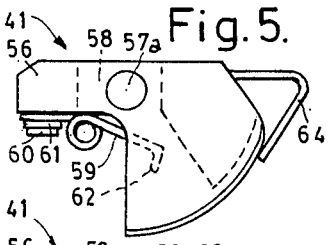
FIG. 5 is a side elevational view of the actuator.
Figure 7:
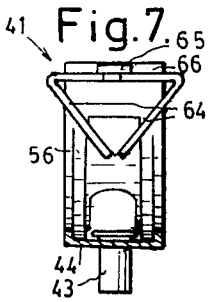
FIG. 7 is an end view of the actuator.
Figure 6:
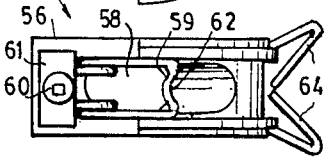
FIG. 6 is a view of the actuator from below.

The plunger 25 is biased to its retracted position, as shown in FIGS. 1 and 2, by a helical tension return spring 33 anchored at one end to a diametral pin 34 through the plug 23 and extending down into the axial bore of the plunger, the other end of the spring secured by a screw 35 engaged in a threaded plug 36 in the plunger bore.

A punch 37, having one end held by a set-screw 38 in the plunger bore, extends coaxially from the plunger.

Figure 8:
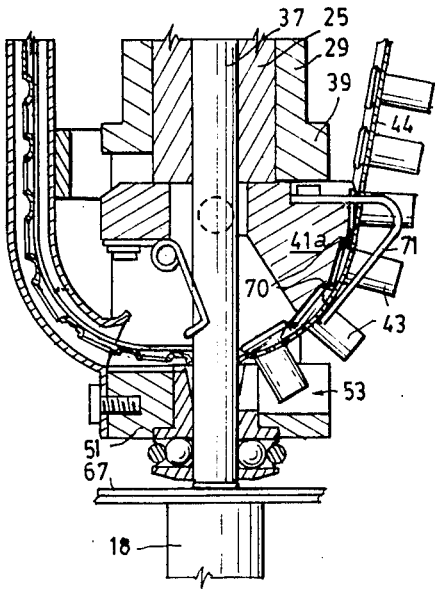
FIG. 8 is a sectional view of part of a rivet setter according to a modification of the invention.

The guide bush 29 is enlarged in diameter below the cylinder 20 to form a guide bush head 39 which limits the retraction of the guide bush into the cylinder and is formed with a transverse opening 40 within which is located an actuator 41, as shown in FIGS. 2 to 6 or alternatively a modifed form of actuator 41*a*, as shown in FIG. 8, both embodiments being hereinafter described.

The guide bush 29 is urged to fully extended position relative to the plunger 25 by a helical compression stripper spring 42 located about the plunger 25 between the plunger shoulder 27 and the inner end of the guide bush 29, and passing freely through the stop ring 32.

Rivets 43 to be fed and set by the device are carried, in equally spaced arrangement, by a carrier tape 44 of a resiliently flexible material, the rivets being held firmly in centrally aligned arrangement in the tape by driven through undersize holes therein. The tape 44 carrying the rivets 43 is fed to the device through a feed tube 45 held to one side of the cylinder 20, above the clamp collar 15, by a clamp 46. This clamp also holds, at the opposite side of the cylinder 20, an outer tape discharge tube 47 within which there is telescopically slidable the upper part of an inner tape discharge tube 48, the lower part of which is releasably secured to the guide bush head 39 by a bracket 49 held by screws (not shown) to the upper part of the guide bush head, and by screws 50 engaged in the lower part of the guide bush head. The slidable engagement of the inner tape discharge tube, fixed to the guide bush head, in the outer tape discharge tube, which is fixed to the hydraulic cylinder, restrains the guide bush and associated parts from rotation relative to the cylinder.

An axial hole formed from the bottom of the guide bush head 39 into the transverse passage 40 accepts a cap nut 51 which has a bore or rivet delivery passage 52, the upper part of which is downwardly tapering, aligned coaxially with the punch 37. A rivet passage 53 leads radially into the rivet delivery passage 52 from a side of the guide bush head 39 and the upper part of the cap nut. A number of steel balls 54 in radial holes in the cap nut protrude into the rivet delivery passage 52, and are urged to inmost position by a resilient band 55 in a circumferential groove about the cap nut and intersecting the radial holes.

Figure 3:
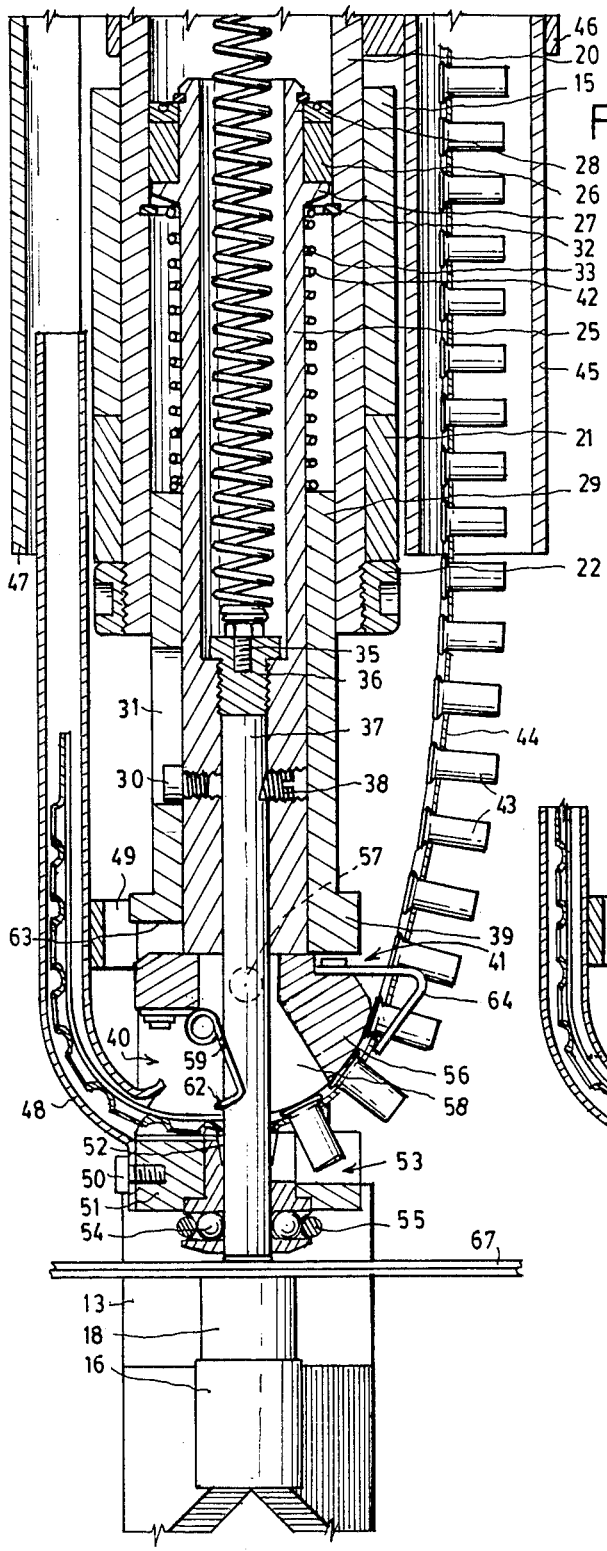
FIG. 3 is a sectional view showing a rivet fed and set in a workpiece.

Referring now to FIGS. 1 to 7 inclusive, the actuator 41 has a body 56 oscillatable about pivot pins 57 fixed in opposed holes 57*a* in the guide bush head 39. The actuator body is formed with a passage 58 through which the punch 37 passes freely whether the actuator is in its advanced or tilted position as shown in FIG. 2, or in its retracted or non-tilted position as shown in FIG. 3. When the plunger 25 and punch 37, and the guide bush 29, are in their fully retracted position (FIG. 2) the actuator 41 is held in its tilted position by a double torsion spring 59 secured at one end, by a screw 60 and plate 61, to one side of the actuator body 56, the spring at its other end 62 being shaped to press slidably against the plunger 37. When the actuator is so tilted, its body at one end, abuts against a shoulder 63 within the guide bush head 39.

When the plunger 31 is extended, it strikes the top of the tilted actuator body forcing it, against the action of the torsion spring 59, to its non-tilted or retracted position as shown in FIG. 3.

A double-pawl spring 64 is fixed, by a screw 65, in a recess 66 in the top of the actuator body, the two arms of this double-pawl being V-shaped and spread apart at the angles, their free ends being brought close together.

In use, the plunger 31 and punch 37, and the guide bush 39, are initially fully retracted as shown in FIG. 2, the actuator 41 being in its advanced or tilted position. The leading end of the carrier tape 44, which is free of rivets for some distance, is carried down from the feed tube 45, between the spread arms of the double-pawl 64, under the bottom of the actuator 41 and up into the inner tape discharge tube 48. As shown particularly in FIG. 8, the carrier tape 44 has raised side edges, and the actuator 41 is recessed to receive these and also to accept the heads of the rivets 43. The tape is drawn under the actuator until the leading rivet 43 is moved through the rivet passage 53 and brought to rest substantially coaxially in the rivet delivery passage 52, directly under and coaxial with the punch 37.

A work piece 67 (FIG. 3) to be riveted is located upon the die 18 and hydraulic fluid under pressure is introduced to the cylinder 20. Thereupon the plunger is extended against the action of its return spring 33 and, at the same time, the guide bush is extended by the action of the stripper spring 42 until the cap nut 51 is brought down onto the work piece 67. Although the guide bush 29 is thus restrained against further movement, the plunger 25 and punch 27 are then further extended, against the action now of the stripper spring 42 as well as the return spring 33. The punch 37 therefore drives the leading rivet through the tape 44 and the rivet delivery passage 52, in which it is correctly aligned by the balls 54, and through the work piece 67 to be deformed by the upsetting die 18. After the punch 37 has penetrated the carrier tape 44 from which it has driven the leading rivet, and therefore holds the tape against movement, the plunger 25 strikes the top of the actuator 40, turning it, against the action of its double torsion spring 59, from its tilted to its nontilted or retracted position. The double spring pawl 64, the ends of which previously engaged the second rivet, as shown in FIG. 2, is thus retracted past, and for some distance beyond, the third rivet, as shown in FIG. 3.

The hydraulic pressure in the cylinder 20 is now relieved so that the plunger 25 is retracted by its return spring 33, first moving clear of the actuator 40, then becoming disengaged from the carrier tape 44, and then, because of the engagement of the key 30 in the slot 31, moving the guide bush 29 to its retracted position so that the actuator 40 can advance to its tilted position under the action of its spring 59. As the actuator so turns, its double pawl 64 engages the third rivet and moves it, and the carrier tape 44, so that the previously second rivet is moved through the rivet passage 53 into the rivet delivery passage 52, aligned coaxially under the retracted punch 37.

The working parts of the riveting machine may be quickly and easily removed from the C-frame 10. The parts are so made and arranged that by detaching the pawl 64 from the actuator 41, and the inner tape discharge tube 48 from the guide bush head 39, and unscrewing the lock nut 22, the cylinder 20 and associated parts may be withdrawn through the clamp collar 15.

Referring now to FIG. 8, the modified actuator 41*a* is formed with ratchet teeth 70 for engaging the heads of the rivets 43. Instead of the pawl 64 shown in FIGS. 1 to 6 for engaging the rivet shanks, there is secured to the body of the actuator 41*a* a double guide spring 71 the ends of which bear against the carrier tape 44 to both sides of a rivet 43 to cause the head of that rivet, or the heads of more than one rivet, firmly into engagement with one or more of the actuator teeth 70.

Feeders for headed fasteners, instead of being applied to a riveting machine as described and illustrated, may be used for ejecting rivets from a carrier tape, one at a time, into a feed tube, for example, or for bringing screws in sequence to a position to be driven by a motor-operated screwdriver.

I claim:

1. A feeder for sequentially feeding, from a flexible carrier tape, charged with headed fasteners driven therethrough in equally spaced intervals, including:

a guide bush, a plunger mounted for limited coaxial advance and retraction through the guide bush, a punch on the leading end of the plunger, a delivery passage in the guide bush to receive the punch on the advance of the plunger, a guide passage in the guide bush for guiding the carrier tape to bring fasteners thereof in sequence to the delivery passage, means for feeding a carrier tape in a curved feed path adjacent said guide bush and to said guide passage, means for advancing the plunger to drive the punch through the tape, expelling a fastener therefrom into the delivery passage, means for retracting the plunger to withdraw the punch from the carrier tape, an actuator oscillatably mounted in the guide bush for movement by the advancing plunger from an advanced position to a retracted position, a surface of said actuator being curved to cooperate with the carrier tape, actuator return means for moving the actuator from its retracted position to its advanced position upon the retraction of the plunger, and fastener engaging means on the actuator adapted, with successive oscillations of the actuator, to engage and advance sequentially towards the delivery passage, the fasteners of the carrier tape.

2. A feeder according to claim 1 wherein the fastener engaging means includes:

a pawl which, on the movement of the actuator to its retracted position, is moved past a fastener shank in the direction away from the delivery passage and, on the reverse movement of the actuator to its advanced position, engages the fastener shank and moves the fastener in the direction of the delivery passage.

3. A feeder according to claim 2 wherein:

the pawl includes two opposed resilient convergent arms extending from the actuator to the side of the tape remote from the actuator.

4. A feeder according to claim 1 wherein the fastener engaging means include:

a ratchet tooth which, on the movement of the actuator to its restricted position, is carried past a fastener head and, on the reverse movement of the actuator to its advanced position, engages the fastener head and moves the fastener in the direction of the delivery passage.

5. A feeder according to claim 4 wherein:

the actuator includes spring-loading means urging the tape and the head of the fastener towards the ratchet tooth.

6. A riveting machine including:

a frame, a rivet upsetting die on the frame, a cylinder on the frame coaxially aligned with and spaced from the die, a guide bush slidable in the cylinder, a delivery passage in the end of the guide bush nearer to the die, a plunger coaxially movable in the cylinder and with limited slidable movement through the guide bush, means for advancing and retracting the plunger through the guide bush, a punch extending from the plunger and arranged to pass through the delivery passage when the plunger is advanced, a guide passage in the guide bush for guiding a carrier tape charged with rivets at equally spaced intervals between the retracted punch and the delivery passage, means for feeding said carrier tape in a curved feed path adjacent said guide bush and to said guide passage, an actuator oscillatably mounted in the guide bush for movement by the advancing plunger from an advanced position to a retracted position, a surface of said actuator being curved to cooperate with said carrier tape, actuator return means for moving the actuator from its retracted position to its advanced position upon the retraction of the plunger, and rivet engaging means on the actuator for engaging a rivet of the carrier tape when the actuator is moved to its retracted position and advancing the rivet towards the delivery passage when the actuator is moved to its advanced position, the parts being so made and arranged that with the advance of the plunger the guide bush is moved to a workpiece on the die, and with further advance of the plunger the punch penetrates the tape, driving a rivet therefrom through the delivery passage and the workpiece to the die.

7. A riveting machine according to claim 6 wherein:

the means for advancing the plunger is hydraulic, the means for retracting the plunger comprises a return spring, and wherein a stripper spring urges the plunger to a retracted position relative to the guide bush.

8. A riveting machine according to claim 6 wherein the rivet engaging means includes:

a ratchet tooth which, on the movement of the actuator to its retracted position is carried past a rivet head and, on the reverse movement of the actuator to its advanced position, engages the rivet head and moves the rivet in the direction of the delivery passage.

9. A riveting machine according to claim 8 wherein:

the actuator includes spring-loading means urging the tape and the head of the rivet towards the ratchet tooth.

10. A riveting machine, including:

a frame, a rivet upsetting die on the frame, a cylinder on the frame coaxially aligned with and spaced from the die, a guide bush slidable in the cylinder, a delivery passage in the end of the guide bush nearer to the die, a plunger coaxially movable in the cylinder and with limited slidable movement through the guide bush, means for advancing and retracting the plunger through the guide bush, a punch extending from the plunger and arranged to pass through the delivery passage when the plunger is advanced, a guide passage in the guide bush for guiding a carrier tape charged with rivets at equally spaced intervals between the retracted punch and the delivery passage, an actuator mounted in the guide bush for movement by the advancing plunger from an advanced position to a retracted position, actuator return means for moving the actuator from its retracted position to its advanced position upon the retraction of the plunger, and rivet engaging means on the actuator for engaging a rivet of the carrier tape when the actuator is moved to its retracted position and advancing the rivet towards the delivery passage when the actuator is moved to its advanced position, the parts being so made and arranged that with the advance of the plunger the guide bush is moved to a workpiece on the die, and with further advance of the plunger the punch penetrates the tape, driving a rivet therefrom through the delivery passage and the workpiece to the die, and wherein the rivet engaging means includes:

a pawl which, on the movement of the actuator to its retracted position, is moved past a rivet shank in the direction away from the discharge passage and, on the reverse movement of the actuator to its advanced position, engages the rivet shank and moves the rivet in the direction of the discharge passage.

11. A riveting machine according to claim 10 wherein:

the actuator is movable in contact with the carrier tape, and the pawl includes two opposed resilient convergent arms extending from the actuator to the side of the tape remote from the actuator.

* * * * *

UNITED STATES PATENT AND TRADEMARK OFFICE

CERTIFICATE OF CORRECTION

PATENT NO. : 4,615,475

DATED : October 7, 1986

INVENTOR(S) : Ralph FUHRMEISTER

It is certified that error appears in the above-identified patent and that said Letters Patent is hereby corrected as shown below:

IN THE TITLE PAGE:

Item [73] should read: "Nietek Pty. Ltd".

Signed and Sealed this

Thirteenth Day of January, 1987

*Attest:*

DONALD J. QUIGG

*Attesting Officer*

*Commissioner of Patents and Trademarks*